US005524852A

United States Patent [19]

Lock et al.

[11] Patent Number: 5,524,852

[45] Date of Patent: Jun. 11, 1996

[54] NON-HAZARDOUS THIRD RAIL ENERGIZING WARNING DEVICE

[76] Inventors: Robert Lock, 33 Pearl Ave., Holtsville, N.Y. 11742; Thomas Dziomba, 11 Mosby Dr., Lake Grove, N.Y. 11755

[21] Appl. No.: 259,193

[22] Filed: Jun. 13, 1994

[51] Int. Cl.[6] ..... G08B 21/00

[52] U.S. Cl. ..... 246/1 C; 246/217; 246/473 R; 340/660

[58] Field of Search ..... 246/217, 473 R, 246/477, 478, 484, 488, 167 A, 1 C; 324/555, 556; 340/309.15, 309.6, 653, 654, 815.4, 815.43, 815.65, 384.1, 384.4, 654, 660, 649, 628, 657

[56] References Cited

U.S. PATENT DOCUMENTS 3,727,559 4/1973 McCune et al. ..... 246/132

4,736,197 4/1988 Buyat et al. ..... 340/654

4,931,768 6/1990 Jincks et al. ..... 246/473.3

*Primary Examiner*—Mark T. Le

*Attorney, Agent, or Firm*—Michael I. Kroll

[57] ABSTRACT

A third rail warning device in which the third rail carries in use a dangerously high voltage. Connected to the third rail is a source of relatively safe voltage as a warning that the dangerously high voltage is about to be applied to the third rail. A time delay is employed to terminate the safe voltage and permit automatic connection of the dangerously high voltage, and an alarm is actuated when the safe voltage is being applied to the third rail.

1 Claim, 2 Drawing Sheets

NON-HAZARDOUS THIRD RAIL ENERGIZING WARNING DEVICE

BACKGROUND OF THE INVENTION

1. Field of the Invention

This invention relates to audio and visual warning and alarm systems and particularly to warning and alarm systems adapted to communicate prior to when a dangerous voltage is present on the third rail of a transit or railroad system.

2. Description of the Prior Art

The intent of this invention is to provide personnel with a non-hazardous warning system prior to third rail energization with 625 volts D.C.

Currently there exist two indication methods of third rail energization which are hazardous to personnel working on tracks. These two methods can be used separately or in conjunction with each other. The first method being a bank light device, hence its name Bank Light Device. This device consists of a set of five 125 volt incandescent bulbs that are wired in series and connected to the third rail by means of alligator clips. The second warning method is an audio-visual device. This device is also activated by a 625 volt D.C. and is connected in the same fashion as the bank light device. In both cases a dangerously high voltage is required to activate these indication devices. There is no prior warning of 625 volt D.C. energization to track personnel.

The typical transit system will have two running rails on which the wheels of the cars roll and a third rail which carries the electric power for the electric motors used to drive the transit cars. This voltage which may typically be 600 volts D.C., although specific systems may have substantially different voltages. The maintenance crews performing work in the vicinity of third rails must have the power turned off on the third rail to avoid an intolerably dangerous working condition. The power to the third rail is typically turned on and off from a remote panel which is not visible to the maintenance crew working near or on the rails.

Maintenance crews have previously relied on make-shift means for determining if a voltage is present on the third rail. These make-shift means have included the use of five conventional incandescent lamps connected in a series. This approach has been unsatisfactory because a single failure of any one of the lamps produced a visual signal which was identical to the signal when no voltage was present. More specifically, although an illuminated string of incandescent lamps connected between one running rail and the third rail indicates electrical power is present, an unlighted string of lamps indicates; (1) no voltage is present or (2) that one or more of the lamps has a burned out filament or (3) there is a bad connection to one of the rails.

A hazard involved in using such apparatus is that the user typically must approach rather closely to the third rail which may be at a relatively high voltage. The high voltage is sufficiently dangerous so that even a slight brush against the third rail may be fatal.

Other problems with these approaches include (1) the test is only a valid test at the instant at which the test is being conducted. In other words, the test is not a continuing test which would produce a very positive signal for the maintenance crew immediately upon turning on power to the third rail. The test can be completed in one instant and an instant later the power can be turned back on and there will be no indication of the power being turned on to warn the maintenance worker that a dangerous voltage level is present on the third rail. Particularly with the light bulb approach, the warning signal is merely a visual signal. It is a continuous test but has two problems: a) bank lights, mainly bulbs, going dead; and b) 625 V D.C. activated (Prior Art FIGS. 1 and 2).

Numerous innovations for third rail warning systems have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a third rail warning device.

More particularly, it is an object of the present invention to provide a third rail warning device which avoids the disadvantages of the prior art.

In one form of the invention the apparatus includes means in the means for indicating which allows the connection of one positive lead to the third rail and the negative lead to one of the other rails which act as a ground.

The object of this invention idea is to provide personnel a warning system activated prior to 625 volt D.C. third rail energization.

It is the intent to accomplish this inventive idea through modification of existing 125 volt D.C. closing coil control circuit, using this less hazardous voltage to activate third rail warning systems.

It is an object of the invention to provide a signalling device for signaling the presence of power on the third rail of a transit system which will provide both an audible and a visual signal indicating the presence of electrical power on the third rail.

It is another object of the invention to provide an apparatus which will perform a continuing test to indicate the presence of power on the third rail.

Still another object of the invention is to provide an apparatus which will function with a wide range of voltages on the third rail.

Another object of the invention is to provide apparatus which is adjustable to engage transit systems of various dimensions and manufacturing origin.

An additional object of the invention is to permit the low voltage apparatus to be used simultaneously while allowing the passage of maintenance vehicles including hand propelled vehicles on the running rails and thus minimize interference and personal hazard to and with maintenance operations which will frequently be conducted utilizing such vehicles.

It has now been found that these and other objects of the invention may be attained in apparatus for indicating the presence of power on the third rail of a transit system having two running rails and a third rail, which includes first means for connecting to the third rail, second means for connecting to one of the running rails and a low voltage generated means for indicating the presence of a voltage prior to and between the first means for connecting and the second means for connecting and thereby indicating a voltage between the one running rail and the third rail, the means for indicating including means for providing a visual and audio warning prior to the presence of a high voltage in a predefined range energizing the third rail.

In one type of embodiment of the invention includes a means for providing an audible indication is an annunciator and the means for providing a visual indication such as a strobe light.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DETAILED DESCRIPTION OF THE PREFERRED EMBODIMENT

Figure 1:
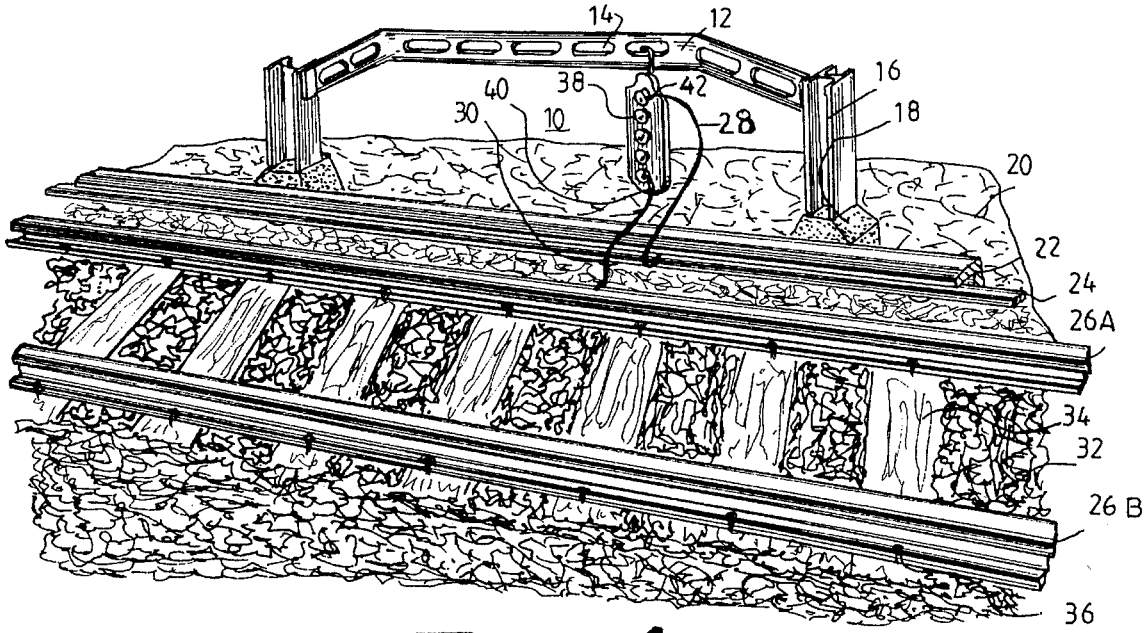
Fig. 1 (PRIOR ART)
FIG. 1 is a perspective view of a third rail voltage indicating means as previously described in prior art.

Referring to FIG. 1, the third rail warning device 10 is electrically connected to the third rail 24 by a positive lead 28 and connected to the grounding rail 26*a* via a negative grounding lead 30. At the terminus of the positive lead 28, a positive lead coupler 42 attaches the positive lead 28 from the third rail 24 to the third rail warning device 10. Concurrently, the negative lead 30 is electrically connected to the third rail warning device 10 via the negative lead coupler 40. The third rail warning device 10 is movably connected to a cross member 12 by a hanger-type of mechanism which is inserted into the cross member opening 14. The third rail 24 is covered by third rail cover 22 but this cover still permits contact of the third rail 24 by a human which presents a hazardous condition.

The cross member 12 is securely connected to a vertical strut 16 which is mounted into a vertical strut base 18. In addition to the inner rail track 26*a* there exists an outer rail track 26*b*, both of which function as the support members upon which a train rides. The rail tracks are securely mounted on railroad ties 34 by railroad spikes 36. The railroad ties 34 are positioned upon the gravel 32 which is surrounded and over soil 20.

When the third rail 24 is energized with high voltage, the warning lights 38 which are mounted within the third rail warning device 10 illuminate. This depiction of a device only exhibits a direct linkage between the third rail 24, inner rail track 26*a* and the third rail warning device 10. Thus, there is not present in FIG. 1 a non-hazardous third rail warning device as described in the present invention. In FIG. 1, when the third rail 24 is energized, simultaneously the third rail warning device 10 illuminates without prior warning to the high voltage energization.

Figure 2:
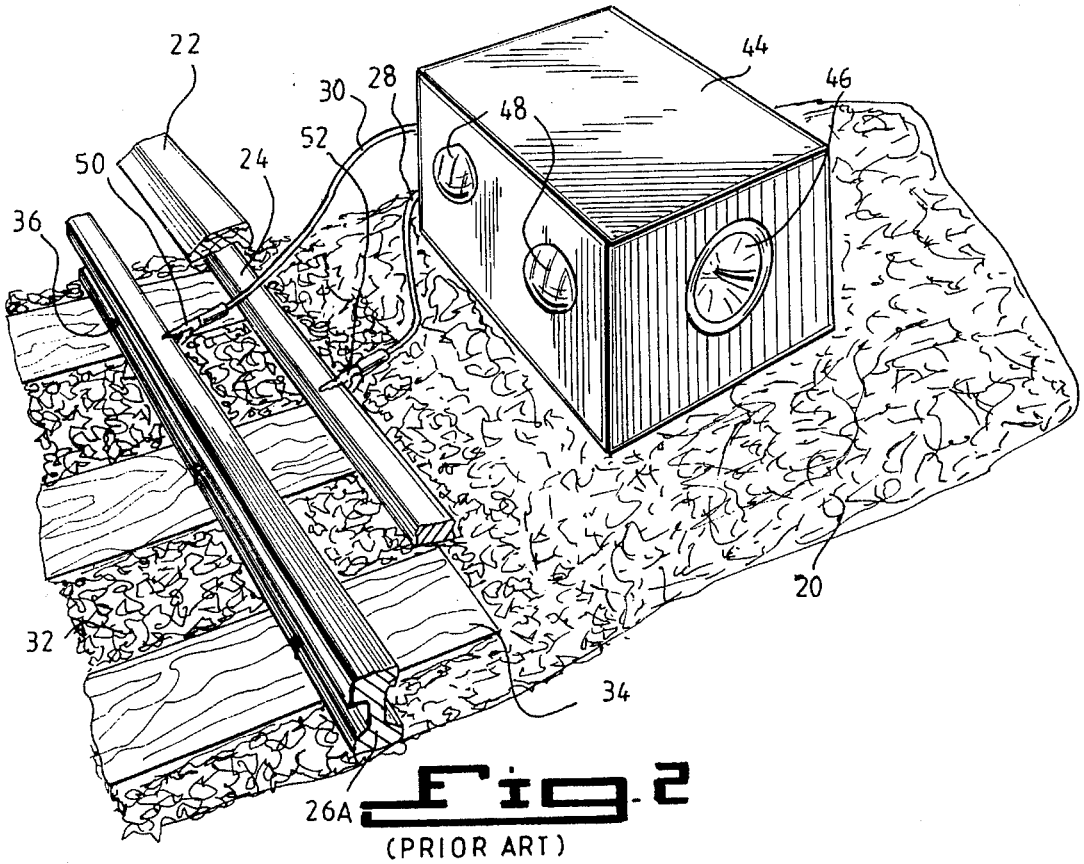
Fig. 2 (PRIOR ART)
FIG. 2 is a perspective view of an audio and visual third rail warning device as previously described in the prior art.

Referring to FIG. 2, another version of a prior art third rail warning device is exhibited which contains both audio 46 and visual 48 warning indicators. Both of the indicators are encased in a housing 44. The positive lead 28 is directly connected to the third rail 24 by a positive lead alligator clip 52. The negative lead 30 is directly connected to the inner rail track 26*a* by a negative lead alligator clip 50.

This depiction of a prior art third rail warning system does not exhibit the novelty of the present invention. Thus, there is not present in FIG. 2 a non-hazardous third rail warning device as described in the present invention. Hence, when the third rail 24 is energized, simultaneously the third rail warning device illuminates and sends an auditory signal without prior warning to the high voltage energization.

Figure 3:
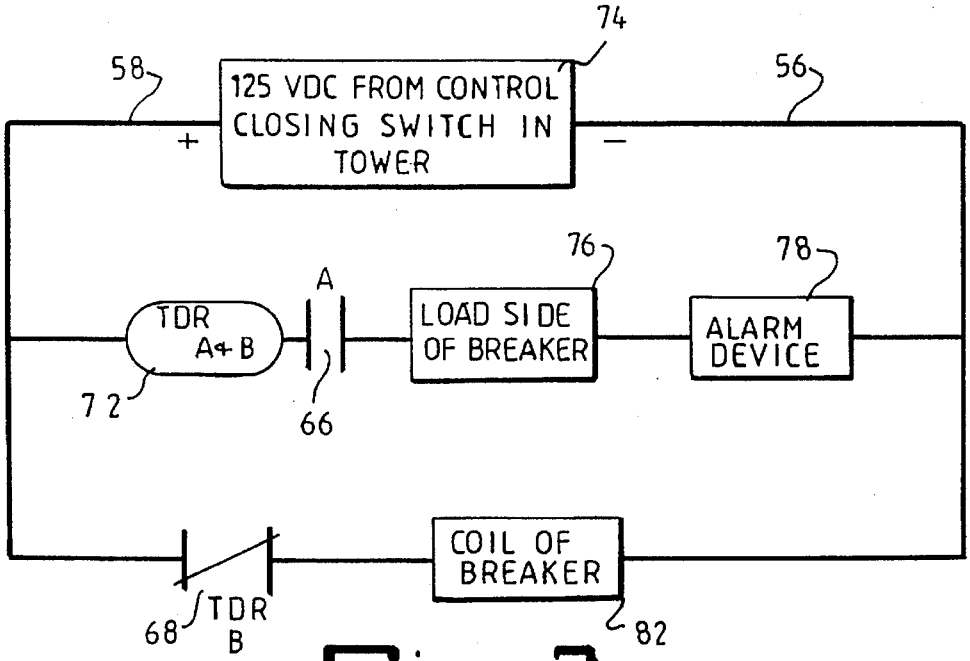
FIG. 3 is an electrical schematic view of an alarm control panel for alarm signal prior to the breaker closing and energizing the third rail.
Figure 4:
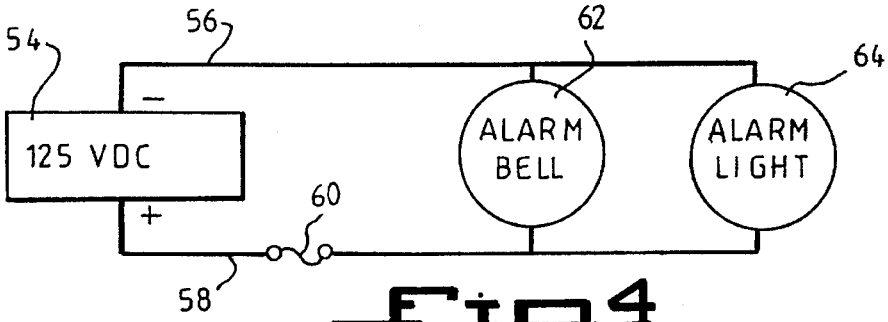
FIG. 4 is an electrical schematic view of an alarm device used in conjunction with a time delay relay alarm circuit 125 VDC from A contacts in the time delay relay of a control panel via the third rail.
Figure 5:
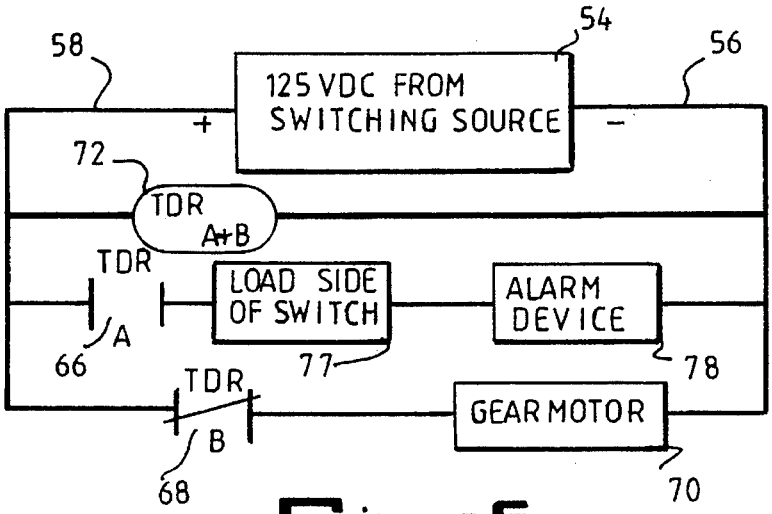
FIG. 5 is an electrical schematic view of an alarm panel for sectionalizing switch.

FIGS. 3–5 show the warning device used in conjunction with the time delay relay alarm circuit (A) and a 125 VDC from the control panel 74 via the third rail 24. The warning device has internal replaceable fuse 60 for protection in case that warning device is not removed prior to third rail 24 energization. The third rail 24 is to be tested prior to the warning device being connected to the third rail 24. The third rail 24 must be tested and de-energized prior to connection of alarm device to third rail 24. The work force is to be notified by railroad agency of time setting of the time delay relays 72 to allow removal of the warning device prior to the high voltage energization of the third rail 24.

A 125 VDC source 54 has a negative lead 56 and a positive lead 58. The positive lead 58 is connected to fuse 60, an alarm bell 62, and an alarm light 64. The negative lead 56 is also connected to an alarm bell 62 and an alarm light 64.

Referring now to FIG. 5 which is an electrical diagram of the warning control panel for sectionalizing switch. The time delay relay contact A 66 closes when the time delay relay 72 is energized, thus, sending 125 V D.C. to the third rail 24 and energizing alarm 78. When predetermined time of TDR 72 elapses contact A 66 opens and contact B 68 closes, thus energizing gear motor 70 from 125 V D.C. switching source 54.

Referring to FIG. 3, which exhibits the alarm control panel for the warning signal prior to the breaker 82 closing and energizing the third rail 24. When the time delay relay contact A 66 has closed and time delay relay contact B 68 has opened, at the moment that time delay relay contact A 66 close. 125 V D.C. is sent from the load side of breaker 76 to the alarm device 78 installed on the third rail 24 signalling the alarm device 78. When the timer expires time delay relay contact A 66 open and time delay relay contact B close which sends 125 V D.C. to the breaker closing coil 82, thus sending 625 V D.C. to third rail 24.

The present invention is a modification of the existing 125 volts D.C. 74 control circuit used to activate the breaker closing coil 82 of a 625 volt D.C. Breaker is as follows. First the 125 volt D.C. 74 to closing coil 82 is re-routed through a time delay relay 72 with a double set of contacts, one normally open and one normally closed. The line side of these contacts are commonly fed with this 125 volt D.C. 74.

The load side of contact a 66 are wired to the load side of the 625 volt D.C. Breaker 76. The load side of contact B 68 are wired to the closing coil 82 of the 625 volt D.C. breaker. When the time delay relay 72 is energized the a contact close sending 125 volt D.C. through existing conductors and activating signal device 78. Thus warning track personnel that third rail 24 energization with 625 volt D.C. is imminent. Simultaneously, the normally closed B 68 contact will open. The length of low voltage signal time to be determined by railroad agency. Once timing sequence has ended contact a 66 opens eliminating warning voltage to third rail 24 and alarm device 78. Simultaneously, the B contact 68 will close thus energizing closing coil 82 of the 625 volt D.C. Breaker, resulting in energization of third rail 24 with 625 volts D.C. This safety system may be adopted to any variety of existing track energization devices such as devices located in breaker houses and sectionalizer switches located on tracks or in sub stations.

Time delay relay 72 is energized closing A 66 contact and opening B 68 contact when A 66 contact close—send 125 V D.C. to alarm device 78 installed on track by work force. When the timer runs out A contact 66 open and B contact 68 close—sending 125 V D.C. 54 to closing coil 82 of breaker thus sending 625 V D.C. to third rail 24. Time setting of the time delay relay are determined by the agency. Alarm device 78 is used in conjunction with time delay relay alarm circuit. 125 V D.C. 54 from A contact 66 in time delay relay of control panel 74 via third rail 24. Alarm device 78 has an internal, replaceable fuse 60 link rated 130 V D.C. for protection in case device is not removed prior to track energization. Third rail 24 is be tested prior to alarm device being connected to rail. Third rail 24 must be de-energized prior to connection of alarm device 78 to rail.

It will be understood that each of the elements described above, or two or more together, may also find a useful application in other types of constructions differing from the type described above.

While the invention has been illustrated and described as embodied in a third rail warning device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A third rail warning device comprising:

a. a third rail carrying when in use a dangerously high voltage;

b. means for connecting to said third rail a source of relatively safe voltage as a warning that said dangerously high voltage is about to be applied to said third rail;

c. time delay means to terminate said safe voltage and permit automatic connection of said high voltage to said third rail; and d. alarm means connected to said third rail to issue a warning that said third rail is receiving said relatively safe voltage, thereby giving workers the time provided by said time delay means to remove themselves from harm's way.

* * * * *